US009231339B1

(12) United States Patent
Stier

(10) Patent No.: US 9,231,339 B1
(45) Date of Patent: Jan. 5, 2016

(54) ELECTRICAL COUPLERS AND METHODS OF USING THEM

(71) Applicant: George Stier, Boones Mill, VA (US)

(72) Inventor: George Stier, Boones Mill, VA (US)

( * ) Notice: Subject to any disclaimer, the term of this patent is extended or adjusted under 35 U.S.C. 154(b) by 228 days.

(21) Appl. No.: 13/890,594

(22) Filed: May 9, 2013

Related U.S. Application Data

(60) Provisional application No. 61/645,279, filed on May 10, 2012.

(51) Int. Cl.
*H01R 4/38* (2006.01)
*H01R 13/621* (2006.01)

(52) U.S. Cl.
CPC ..... *H01R 13/621* (2013.01)

(58) Field of Classification Search
CPC ..... H01R 4/2408; H01R 4/44; H01R 4/305; H01R 4/2454; H01R 11/12; H02G 3/0691
USPC ..... 439/815
See application file for complete search history.

(56) References Cited

U.S. PATENT DOCUMENTS

| | | | | |
|---|---|---|---|---|
| 4,723,920 | A * | 2/1988 | Werner | 439/782 |
| 4,915,653 | A * | 4/1990 | Mair | 439/781 |
| 5,957,738 | A * | 9/1999 | Schryer | 439/883 |
| 6,604,956 | B2 * | 8/2003 | Ruiz et al. | 439/409 |
| 7,909,633 | B1 * | 3/2011 | Miller et al. | 439/441 |
| 8,025,521 | B2 * | 9/2011 | Diniz et al. | 439/395 |
| 2011/0290550 | A1 * | 12/2011 | Kiely | 174/480 |

* cited by examiner

*Primary Examiner* — Jean F Duverne
(74) *Attorney, Agent, or Firm* — Rhodes IP PLC; Christopher R Rhodes

(57) ABSTRACT

Certain embodiments described herein are directed to couplers configured to provide an electrical connection between two or more separate electrical wires. In certain embodiments, the coupler is configured to provide the electrical connection without the two electrical wires physically contacting each other. In other instances, the coupler can be configured to provide an electrical connection between the wires without the use of an electrical box or wiring nuts.

18 Claims, 13 Drawing Sheets

ELECTRICAL COUPLERS AND METHODS OF USING THEM

PRIORITY APPLICATION

This application claims priority to, and the benefit of, U.S. Provisional Application No. 61/645,279 filed on May 10, 2012, the entire disclosure of which is hereby incorporated herein by reference for all purposes.

TECHNOLOGICAL FIELD

Certain features, aspects and embodiments are directed to couplers configured to provide electrical coupling between two or more electrical wires. In some examples, the couplers can be configured to provide a boxless, electrical connection between the two electrical wires.

BACKGROUND

Electrical wires such as Romex® cable are typically connected to separate cables through the use of wire nuts. Under current building codes, the connection must be performed within a box. Twisting of the wires together in the box does not provide a secure connection.

SUMMARY

In a first aspect, a device configured to provide electrical coupling between a first electrical wire and a second electrical wire is provided. In certain examples, the device comprises a non-conductive housing comprising a base and a top configured to releasably engage the base to secure the first and second electrical wires in the housing. In some examples, the device can also comprise a conductive element disposed in the housing and configured to receive the first electrical wire at one side such that an exposed conductive portion of the electrical wire is positioned entirely within the housing and configured to receive the second electrical wire at another side of the housing such that an exposed conductive portion of the second electrical wire is positioned entirely within the housing, in which the top of the housing is configured to bias the two exposed conductive portions of the electrical wires against the conductive element to provide the electrical coupling between the first and second electrical wires and to secure the first and second electrical wires within the device.

In certain embodiments, the conductive element can be disposed in the top of the non-conductive housing. In other embodiments, the conductive element can be disposed in the base of the non-conductive housing. In further embodiments, the conductive element can be disposed in the top of the non-conductive housing, and the base of the non-conductive housing comprises an additional conductive element disposed in the base. In some examples, the device can include a conductive insert configured to be sandwiched between the top and the base and provide an electrical connection between the first electrical wire and the second electrical wire. In other examples, the conductive element can be molded into one of the top and the base. In some examples, the base comprises threads configured to receive a screw in the top housing and which mating of the screw to the threads of the base is configured to bias the two exposed conductive portions of the electrical wires against the conductive element to provide the electrical coupling between the first and second electrical wires and to secure the first and second electrical wires within the device. In certain examples, the base comprises a female connector configured to receive a male connector on the top of the housing, in which coupling of the male connector of the top to the female connector of the base is configured to bias the two exposed conductive portions of the electrical wires against the conductive element to provide the electrical coupling between the first and second electrical wires and to secure the first and second electrical wires within the device. In other examples, the base comprises a male connector configured to receive a female connector on the top of the housing, in which coupling of the female connector of the top to the male connector of the base is configured to bias the two exposed conductive portions of the electrical wires against the conductive element to provide the electrical coupling between the first and second electrical wires and to secure the first and second electrical wires within the device.

In certain embodiments, at least one of the top and the base comprises a locking device configured to engage a non-exposed portion of each wire in the housing. In other examples, the locking device comprises one or more teeth. In some embodiments, the locking device comprises one or more high friction surfaces. In certain examples, the device can include a second conductive element disposed in the top of the housing, with the conductive element disposed in the base of the housing, and configured to receive the first electrical wire at one side such that the exposed conductive portion of the electrical wire is positioned entirely within the housing and contacting the second conductive element, in which the second conductive element is configured to receive the second electrical wire at another side of the housing such that an exposed conductive portion of the second electrical wire is positioned entirely within the housing and contacting the second conductive element, in which tightening of the top of the housing to the base of the housing sandwiches the exposed portion of the wire between the conductive element and the second conductive element.

In certain examples, the device can also include a securing device on the housing and configured to be coupled to a physical structure. In some embodiments, the securing device comprises a fastener configured to mate with a surface and retain the device to the surface. In certain examples, the fastener can be one or more of a screw, a nail, hook and loop fastener, double-sided tape, an adhesive strip and combinations thereof.

In certain embodiments, the housing of the device can include lateral openings to receive the first electrical wire and the second electrical wire. In other embodiments, the housing of the device can include a dorsal opening to receive the first electrical wire and a ventral opening to receive the second electrical wire. In some embodiments, the housing of the device can include a lateral opening to receive the first electrical wire and a dorsal opening to receive the second electrical wire. In certain examples, the housing of device can include a lateral opening to receive the first electrical wire and a ventral opening to receive the second electrical wire.

In certain examples, the non-conductive housing comprises a plastic material or other insulating material. In some examples, the non-conductive housing comprises an effective amount of a flame retardant, a smoke suppressant or other materials designed to deter catching of the device on fire.

In some embodiments, the top of the housing is configured to irreversibly engage the base of the housing such that the top cannot be separated from the base without destruction of the housing.

In certain embodiments, the housing further comprises a set of electrical couplers configured to couple to an electrical device. In some examples, the set of electrical couplers are configured to couple to an electrical switch, an electrical outlet, an electrical circuit breaker or combinations thereof.

In certain examples, the conductive element can be a flat copper element configured to contact each of the exposed portions of the first electrical wire and the second electrical wire when the top is engaged to the base, and in which the top of the housing and the base of the housing each comprises a non-conductive plastic material. In other examples, the conductive element comprises one or more of a conductive film, metal particles, nanoparticles and combinations thereof.

In certain embodiments, the electrical coupling provided by the devices described herein can be provided without the use of an electrical box. In some embodiments, the electrical coupling provided by the devices described herein can be provided without the use of any wire nuts. In other embodiments, the electrical coupling provided by the devices described herein can be provided without physical contact of the exposed conductive portions of the first and second electrical wires.

In another aspect, a device configured to provide electrical coupling between wires of a first non-metallic sheathed electrical cable and wires of a second non-metallic sheathed electric cable without physically connecting hot wires and return wires of the first and second non-metallic sheathed electrical cables is described. In certain examples, the device comprises a non-conductive housing comprising a base and a top configured to releasably engage the base to secure the first and second electrical wires in the housing. In some examples, the device can also include a first conductive element disposed in the housing and configured to engage an exposed portion of a hot wire from the first non-metallic sheathed electrical cable at a first side of the housing and configured to engage an exposed portion of a hot wire from the second non-metallic sheathed electrical cable at a second side of the housing. In other examples, the device can also include a second conductive element disposed in the housing and configured to engage an exposed portion of a return wire from the first non-metallic sheathed electrical cable at the first side of the housing and configured to engage an exposed portion of a return wire from the second non-metallic sheathed electrical cable at the second side of the housing. In some configurations, the housing can include a grounding plate on the housing that is configured to receive a ground wire from the first non-metallic sheathed electrical cable and a ground wire from the second non-metallic sheathed electrical cable. In other configurations, the top of the housing can include a fastener configured to bias the exposed conductive portions of the hot wires against the first conductive element and to bias the exposed conductive portions of the return wires against the second conductive element to provide the electrical coupling between the hot wire of the first non-metallic sheathed electrical cable and the hot wire of the second non-metallic sheathed electrical cable and to provide electrical coupling between the return wire of the first non-metallic sheathed electrical cable and the return wire of the second non-metallic sheathed electrical cable.

In certain embodiments, the housing can be color-coded to provide visual guidance for insertion of the hot wires into the device. In other embodiments, the housing can be color-codes to provide visual guidance for insertion of the return wires into the device. In some examples, at least one of the first conductive element and the second conductive element is disposed in the top of the non-conductive housing. In other examples, at least one of the first conductive element and the second conductive element is disposed in the base of the non-conductive housing. In certain examples, the first and second conductive elements are disposed in the top of the non-conductive housing and in which the base of the non-conductive housing comprises a third conductive element and a fourth conductive element disposed in the base. In certain embodiments, the device can include a conductive insert configured to be sandwiched between the top and the base, in which the conductive insert is configured to provide an electrical connection between the first electrical wire and the second electrical wire. In other examples, the conductive element can be molded into one of the top and the base.

In some embodiments, the base can include threads configured to receive a screw in the top housing and which mating of the screw to the threads of the base is configured to bias the two exposed conductive portions of the hot and return wires against the conductive elements to provide the electrical coupling between the hot wires and the return wires and to secure the hot wires and return wires within the device. In other embodiments, the base can include an additional set of threads configured to receive a second screw in the top housing and which mating of the second screw to the additional threads of the base is configured to provide additional bias of the two exposed conductive portions of the hot and return wires against the conductive elements to provide the electrical coupling between the hot wires and the return wires and to secure the hot wires and return wires within the device.

In certain embodiments, the can include a first connector configured to mate to a second connector on the top of the housing, in which coupling of the second connector of the top to the first connector of the base is configured to bias the exposed conductive portions of the hot wires and the return wires against the conductive element to provide the electrical coupling between the hot wires and the return wires and to secure the hot wires and return wires within the device.

In some embodiments, at least one of the top and the base comprises a locking device configured to engage insulation on each of the hot wires and the return wires. In certain configurations, the locking device comprises one or more teeth. In other configurations, the locking device comprises one or more high friction surfaces.

In certain examples, the device can also include a third conductive element disposed on the top of the housing and configured to engage an exposed portion of the hot wire from the first non-metallic sheathed electrical cable at the first side of the housing and configured to engage an exposed portion of the hot wire from the second non-metallic sheathed electrical cable at the second side of the housing.

In other examples, the device can also include a fourth conductive element disposed on the top of the housing and configured to engage an exposed portion of the return wire from the first non-metallic sheathed electrical cable at the first side of the housing and configured to engage an exposed portion of the return wire from the second non-metallic sheathed electrical cable at the second side of the housing.

In some embodiments, the devices described herein can include a securing device on the housing and configured to be coupled to a physical structure. For example, the securing device can include a fastener configured to mate with a surface and retain the device to the surface. In some embodiments, the fastener can be one or more of a screw, a nail, hook and loop fastener, double-sided tape, an adhesive strip and combinations thereof.

In certain embodiments, the housing can comprise lateral openings to receive the hot wires and the return wires. In other embodiments, the housing can comprise a dorsal opening to receive the hot and return wires from the first non-metallic sheathed electrical cable and a ventral opening to receive the hot and return wires from the second non-metallic sheathed electrical cable. In other embodiments, the housing can include a lateral opening to receive the hot and return wires from the first non-metallic sheathed electrical cable and a dorsal opening to receive the hot and return wires from the second non-metallic sheathed electrical cable. In some embodiments, the housing can include a lateral opening to hot and return wires from the first non-metallic sheathed electrical cable and a ventral opening to receive the hot and return wires from the second non-metallic sheathed electrical cable.

In certain embodiments, the non-conductive housing comprises a plastic material or other insulating material. In some embodiments, the non-conductive housing comprises an effective amount of a flame retardant, a smoke suppressant or both.

In some examples, the top of the housing can be configured to irreversibly engage the base of the housing such that the top cannot be separated from the base without destruction of the housing.

In certain embodiments, the housing further comprises a set of external electrical couplers configured to couple to an electrical device. In some embodiments, the set of electrical couplers are configured to couple to an electrical switch, an electrical outlet, an electrical circuit breaker or combinations thereof.

In certain examples, each of the first conductive element and the second conductive element is a flat copper element configured to contact each of the exposed portions of the wires when the top is engaged to the base. In other examples, the base comprises threads configured to receive a screw in the top housing and which mating of the screw to the threads of the base is configured to bias the two exposed conductive portions of the hot and return wires against the conductive elements to provide the electrical coupling between the hot wires and the return wires and to secure the hot wires and return wires within the device. In some configurations, the housing comprises lateral openings to receive the hot wires and the return wires. In other configurations, the housing comprises a securing device configured to couple the housing to a physical structure. In certain instances, the top of the housing and the base of the housing each comprises a non-conductive plastic material. In other embodiments, the top of the housing and the base of the housing further comprise a flame retardant material. In further embodiments, the top of the housing and the base of the housing further comprise a smoke retardant material.

In certain embodiments, in which at least one of the top and the base comprises a locking device configured to engage insulation on each of the hot wires and the return wires. In certain examples, the locking device comprises one or more teeth or high friction surfaces. In other examples, the electrical coupling is provided without the use of an electrical box. In other configurations, the electrical coupling is provided without the use of any wire nuts. In additional embodiments, the electrical coupling is provided without physical contact of the exposed conductive portions of the first and second electrical wires. In some instances, the opening of the device configured to receive the electrical wire is sized and arranged for a specific gauge of electrical wire.

In an additional aspect, a device configured to provide electrical coupling between wires of a first non-metallic sheathed electrical cable and wires of a second non-metallic sheathed electric cable without the use of any electrical box is disclosed. In certain embodiments, the device comprises a housing comprising a top and a base, the top of the housing configured to tighten to the base of the housing through a fastening means. In other embodiments, the device can include a pair of conductive elements disposed in the housing and configured to engage a surface of a corresponding pair of conductive wires at each end of the pair of conductive elements, the conductive elements each sized and arranged to be entirely within the non-conductive housing when the top of the housing is tightened to the base of the housing. In some examples, the device can include a set of fasteners coupled to the top of the housing and electrically coupled to a grounding plate configured to receive ground wires from the non-metallic sheathed electrical cable.

In certain embodiments, the top or base or both of the housing is color-coded to provide visual guidance for insertion of the hot wires and/or the return wires into the device. In other embodiments, at least one of the pair of conductive elements is disposed in the top of the non-conductive housing. In an additional embodiment, at least one of the pair of conductive elements is disposed in the base of the non-conductive housing. In other configurations, the pair of conductive elements are disposed in the top of the non-conductive housing and in which the base of the non-conductive housing comprises an additional pair of conductive elements disposed in the base. In some examples, the device can include a conductive insert configured to be sandwiched between the top and the base and provide an electrical connection between the wires of the first non-metallic sheathed electrical cable and the wires of the second non-metallic sheathed electric cable. In other embodiments, the conductive elements are molded into one of the top and the base.

In certain instances, the housing comprises at least four openings each sized and arranged to receive a single wire, in which the size of the opening is substantially the same as the gauge size of the wire including the insulation on the wire to provide a friction fit between the insulation of the wire and the housing when the top of the housing has not been tightened to the base though the fastening means. In some embodiments, a first conductive element is disposed on the base of the housing and configured to engage an exposed portion of a hot wire from the first non-metallic sheathed electrical cable at a first side of the housing and configured to engage an exposed portion of a hot wire from the second non-metallic sheathed electrical cable at a second side of the housing.

In certain embodiments, the conductive element can be L-shaped, planar, rod-shaped or may take other geometric shapes. Where two or more conductive elements are present, the conductive elements may have the same shape or may have different shapes.

In certain examples, the device can include a second conductive element disposed on the base of the housing and configured to engage an exposed portion of a return wire from the first non-metallic sheathed electrical cable at the first side of the housing and configured to engage an exposed portion of a return wire from the second non-metallic sheathed electrical cable at the second side of the housing.

In some embodiments, the electrical coupling is provided without the use of any wire nuts. In other embodiments, the electrical coupling is provided without physical contact of the exposed conductive portions of the first and second electrical wires. In certain examples, the conductive element comprises one or more of a conductive film, metal particles, nanoparticles and combinations thereof.

In another aspect, a kit comprising a coupler configured to provide an electrical connection between two or more electrical wires or between an electrical wire and an electrical device is disclosed. In certain embodiments, the coupler of the kit comprises a non-conductive housing comprising a base and a top configured to releasably engage the base to secure the first and second electrical wires in the housing, and a first conductive element disposed on the base of the housing and configured to engage an exposed portion of a hot wire from a first non-metallic sheathed electrical cable at a first side of the housing. In other examples, the coupler of the kit may also include a second conductive element disposed on the base of the housing and configured to engage an exposed portion of a return wire from the first non-metallic sheathed electrical cable at the first side of the housing. In additional embodiments, the coupler of the kit may also include a fastener on the housing that is configured to receive a ground wire from the first non-metallic sheathed electrical cable; and in which the top of the housing is configured to bias the exposed conductive portions of the hot wire against the first conductive element and to bias the exposed conductive portions of the return wire against the second conductive element.

In certain embodiments, the kit can include an electrical device configured to couple to coupler, the electrical device comprising a first electrical connector and a second electrical connector each configured to couple to a terminal on the coupler to provide an electrical connection between the first connector of the electrical device and a first terminal of the coupler that is electrically coupled to the first conductive element and to provide an electrical connection between the second connector of the electrical device and a second terminal of the coupler that is electrically coupled to the second conductive element, in which the first electrical connector and the second electrical connector are enclosed within the coupler device when they are coupled to the coupler. In some examples, the kit can also include a cover configured to encase the coupler. In additional examples, the coupler further comprises an integral fastener configured to fasten the housing to a physical structure. In some examples, the kit can include a fastener configured to engage to the coupler and fasten the coupler to a physical structure.

In certain examples, the kit can include a plurality of the couplers packaged together. In some examples, at least two of the couplers are sized and arranged differently. In other examples, at least two of the couplers are sized and arranged to accept different gauges of wire. In some embodiments, the kit can also include instructions for using the coupler to electrically couple two non-metallic sheathed electrical cables. In certain examples, the kit can also include instructions for using the coupler to electrically couple the coupler to an electrical device. In some examples, the kit can also include at least one insert configured to be placed between the top and the base. In certain embodiments, the kit can also include at least one grounding plate configured to engage the housing of the coupler. In other embodiments, the kit can also include instructions for using the coupler to electrically couple two electrical wires without any physical contact of the electrical wires. In some examples, the kit can include a plurality of couplers packaged together, in which at least one of the coupler is sized and arranged to receive a first gauge wire and wherein at least one second coupler is sized and arranged to receive a different gauge wire than the first gauge wire. In additional embodiments, the kit can include a potting compound.

In additional aspect, an electrical device configured for boxless installation is provided. In certain examples, the electrical device comprising a first electrical connector and a second electrical connector each configured to couple to a terminal on a wiring device to provide an electrical connection between the first connector of the electrical device and a first terminal of the wiring device that is electrically coupled to a hot wire and to provide an electrical connection between the second connector of the electrical device and a second terminal of the wiring device that is electrically coupled to a return wire, in which the first electrical connector and the second electrical connector are enclosed within the wiring device when they are coupled to the wiring device.

In certain embodiments, the first electrical connector is configured to couple to the wiring device and contact a first conductive element of the wiring device that is electrically coupled to the hot wire, and the second electrical connector is configured to couple to the wiring device and contact a second conductive element of the wiring device that is electrically coupled to the return wire. In other embodiments, the wiring device comprises a grounding device on the housing of the wiring device.

In additional embodiments, the electrical device comprises a grounding terminal configured to couple to the grounding device when the electrical device is coupled to the wiring device. In certain examples, the electrical device can include a third connector configured to couple to a ground connector on the wiring device, in which the third connector is enclosed within the wiring device when it is coupled to the wiring device.

In some examples, the electrical device can be configured as an electrical switch, an electrical outlet, a circuit breaker, a 3-way switch or other commonly used outlets and switches. In other examples, the 3-way switch further comprises an additional connector configured to couple to another wiring device. In additional examples, the 3-way switch further comprises an additional connector configured to couple to a third terminal on the wiring device.

In another aspect, a method of electrically coupling a first electrical wire and a second electrical wire with an electrical coupler comprising a non-conductive housing comprising a base and a top and a conductive element disposed in the non-conductive housing is described. In certain examples, the method comprises inserting an exposed portion of the first electrical wire into one port of the housing, inserting an exposed portion of the second electrical wire into a second port of the housing, and tightening the top of the non-conductive housing to the base of the non-conductive housing to provide contact between the exposed portion of the first electrical wire with the conductive element and contact between the exposed portion of the second electrical wire with the conductive element to provide the electrical coupling between the first and second electrical wires.

In certain embodiments, the method can include providing the electrical coupling without physical contact between the exposed portions of the first and second electrical wires. In certain examples, tightening of the top to the base encloses the exposed conductive portions of the wires within the coupler. In other examples, the method can include placing a cover on the electrical coupler after insertion of the wires. In additional examples, the method can include attaching the electrical coupler with the inserted wires to a physical structure. In some embodiments, the method can include comprising disposing a potting compound on the electrical coupler after insertion of the wires. In certain examples, the method can include coupling an additional set of electrical wires to coupling ports on the electrical connector.

Additional features, aspects and examples are described in more detail below.

BRIEF DESCRIPTION OF THE SEVERAL VIEWS OF THE DRAWINGS

Certain illustrative embodiments are described in more detail below with reference to the accompanying figures in which.

It will be recognized by the person of ordinary skill in the art, given the benefit of this disclosure, that the relative positions and sizes of the components in the figures are not limiting and that no particular size, dimension, thickness or arrangement is implied as being required based on the representations of the components shown in the figures.

DETAILED DESCRIPTION

Certain specific examples are described below to illustrate further some of the novel aspects of the technology described herein.

In certain examples, the electrical couplers described herein can be used in boxless coupling of electrical wires. For example, the electrical couplers can be configured to secure first and second electrical wires in the connector such that conductive portions of the electrical wires are not exposed to the environment. In some examples, the electrical coupling can be provided without physical contact of the two electrical wires. The couplers described herein can be used in both dry and wet environments and, if desired, can be color-coded, include labels, marks or the like to facilitate their use. The couplers described herein can include one or more openings in the top and/or bottom components, and the exact shape of the openings can vary and may be, for example, circular, semi-circular, square, half-square, rectangular, ovoid, elliptical or other geometric shapes.

Figure 1:
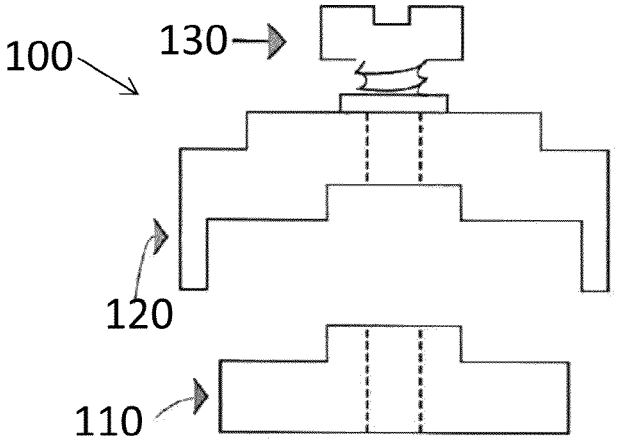
FIG. 1 is an illustration of an electrical coupler configured to couple two wires, in accordance with certain examples.

In certain embodiments and referring to FIG. 1, an illustration of a 2-wire coupler is shown. While reference is made to a 2-wire coupler, each of the wires may be solid wire or stranded wire comprising a plurality of different wire strands twisted or braided together. The coupler 100 comprises a base 110, a top 120 and a fastener 130. The coupler 110 comprises a port on each side of the coupler that can receive an electrical wire. In some embodiments, the size of the port can be selected or matched to the diameter of the wire. For example, where the coupler 100 is designed for use with 16 gauge wire or larger, the port can have a maximum diameter or about 1 $mm^2$. Where the coupler is designed for use with 14 gauge wire or smaller, the port can have a maximum diameter of about 2 $mm^2$. Where the coupler is designed for use with 12 gauge wire or smaller, the port can have a maximum diameter of about 3 $mm^2$. Where the coupler is designed for use with 10 gauge wire or smaller, the port can have a maximum diameter of about 5 $mm^2$. Where the coupler is designed for use with 8 gauge wire or smaller, the port can have a maximum diameter of about 8 $mm^2$. By sizing the ports appropriately, wires of larger diameter, which are designed to carry more current, will not be improperly used with a particular coupler, which could cause melting of the coupler and/or a fire hazard. It may be desirable to have the maximum diameter be about 5% larger than the diameter of the wire to facilitate insertion of the wire into the ports of the coupler 100.

Referring again to FIG. 1, the base 110 and the top 120 of the housing can be produced from non-conductive materials such that when the wires are inserted into the coupler 100, the top 120 and the base 110 act as insulators. Illustrative non-conductive materials include plastics, non-metals, rubbers and combinations thereof. In some embodiments, the base 110 and the top 120 can be produced using the same materials, whereas in other embodiments the base 110 and the top 120 can be produced using different materials. In some examples, the material of the housing may include halogenated materials either within the material, e.g. polyvinyl chloride, or added to the material, e.g., as a halogenated flame retardant. In other embodiments, the housing may include smoke suppressants and the like to deter smoking if the coupler gets overheated and melts.

In certain examples, the fastener 130 of the coupler 100 can be configured to engage to the base 110 such that tightening of the fastener 130 to the base 110 results in forcing of the top 120 against the base 110 and retention of the wire within the coupler. In some embodiments, the fastener 130 can be configured as a screw that mates with threads in the base 110. In certain configurations, one or more stop may be present such that the fastener 130 cannot be removed from the top 120 or so that the fastener 130 can only be tightened a certain amount to avoid damage to the coupler 100. In some examples, the stop can be configured such that the top 120 cannot be removed from the base 120 after assembly of the coupler 100. While shown as a screw type fastener in FIG. 1, the fastener may alternatively take the form of female/male connectors. For examples, the base 110 can include a female connector configured to receive a male connector on the top 120 of the housing, in which coupling of the male connector of the top 120 to the female connector of the base 110 is configured to bias the two exposed conductive portions of the electrical wires in the coupler 100 against a conductive element to provide the electrical coupling between the first and second electrical wires and to secure the first and second electrical wires within the coupler 100. In a different configuration, the base 110 can include a male connector configured to receive a female connector on the top 120 of the housing of the coupler, in which coupling of the female connector of the top 120 to the male connector of the base 110 is configured to bias the two exposed conductive portions of the electrical wires against a conductive element to provide the electrical coupling between the first and second electrical wires and to secure the first and second electrical wires within the coupler 100. In other configurations, the top, the base or both can include a locking device configured to engage a non-exposed portion of each wire in the housing of the coupler 100. For example, the locking device can include one or more teeth or structural components designed to engage or physically contact the wire to aid in retention of the wire in the coupler 100. In other configurations, the locking device in the coupler 100 can include one or more high friction surfaces that generally deter pulling of the wires out of the coupler 100 once the top 120 is tightened or engaged to the base 110 of the coupler 100.

Figure 2:
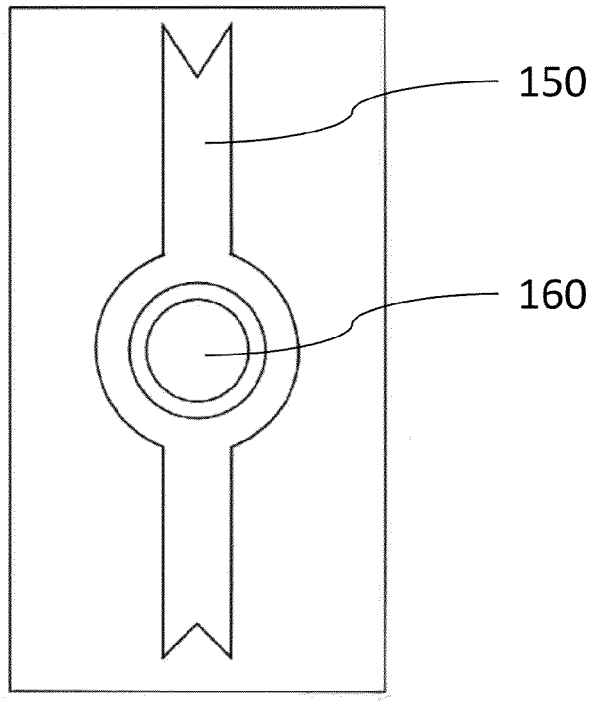
FIG. 2 is an illustration of a conductive element of the coupler of FIG. 1, in accordance with certain examples.
Figure 3A:
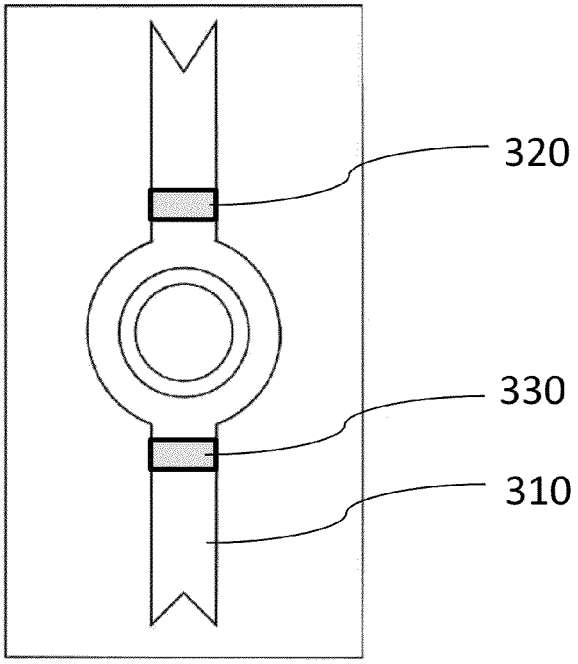
FIGS. 3A and 3B are illustrations of conductive elements including stops, in accordance with certain examples.
Figure 3B:
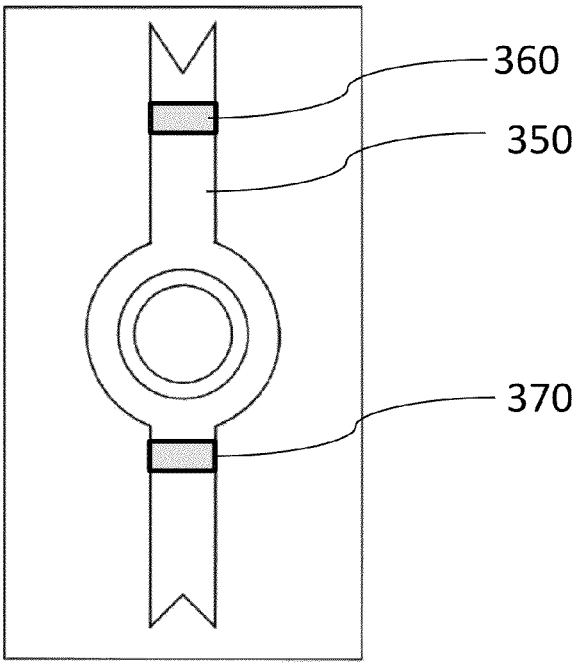

In certain embodiments and referring to FIG. 2, the coupler can also include a conductive element 150 disposed in the housing of the coupler 100 and configured to receive a first electrical wire at one side such that an exposed conductive portion of the electrical wire is positioned entirely within the housing of the coupler 100. The conductive element 150 can include an opening 160 to provide a passageway for the fastener 130. The passageway is generally electrically isolated from the conductive element 150 such that no current can be provided from the conductive element 150 to the fastener 130. The conductive element 150 and the coupler 100 can also be configured to receive the second electrical wire at another side of the housing such that an exposed conductive portion of the second electrical wire is positioned entirely within the housing of the coupler 100. Depending on the desired configuration, the conductive element 150 can be disposed on or in the base 110 or on or in the top 120. If desired, the conductive element 150 can be molded into the base 110 or the top 120 such that it cannot be removed from the components of the coupler 100. In other configurations, the conductive element 150 may be configured as an insert that can be disposed between the base 110 and the top 120 prior to assembly of the coupler 100. In use of the coupler 100, an exposed portion of one electrical wire is positioned against one side of the conductive element 150 and an exposed portion of a second electrical wire is positioned against an opposite side of the conductive element 150. Physical coupling between the wires and the conductive element permits a current to pass from the first wire through the conductive element 150 and on to the second wire without any physical connection between the two wires. If desired, a bump or stop may be present on the conductive element 150 to prevent over insertion of the electrical wires. One configuration is shown in FIG. 3A. The conductive element 310 comprises a stop 320 and a stop 330 each designed to prevent over insertion of the electrical wire into the coupler 100. The stops 320 and 330 are positioned about the same distance along the conductive element 310 such that the length of wire inserted into the coupler would be about the same on each side. If desired, however, the stops can be spaced asymmetrically as shown in FIG. 3B. For example, a first stop 360 on a conductive element 350 can be closer to the opening of a port of the coupler than the second stop 370, which is positioned closer to an opening in the conductive element 350 designed to permit passing of a fastener. In some configurations, the stops can be produced using the same material as the conductive element, whereas in other configurations the stops can be produced from insulating materials to provide increased separation between the fastener passage and the electrical wires inserted into the coupler.

In certain embodiments, the conductive element can be disposed or molded into the top of the coupler. For example, the conductive element may be present as a solid strip of material that is positioned on the ventral portion of the top of the coupler. When the top of the coupler is engaged to the base of the coupler, the conductive element on the top is forced into contact with the top of the wire inserted into the coupler. In other configurations, the conductive element can be disposed or molded into the base of the coupler. For example, when the top of the coupler is engaged to the base of the coupler, the conductive element on the base is forced into contact with the bottom of the wire inserted into the coupler. If desired, a conductive element can be disposed on both the top and the base of the conductor. In other embodiments, the conductive element can be configured as an insert that is placed between the top and the base and held in place when the top is engaged to the base.

In certain embodiments, the conductive element can include one or more materials effective to permit or transfer current from one wire to another wire through the conductive element. In some examples, the conductive element can be produced from a solid metal such as copper, gold, silver or the like, whereas in other examples the conductive element can include a metal coating, film or layer disposed directly on the top, the base or both the top and the base of the coupler. The exact thickness and length of the conductive element can vary from coupler to coupler. For example, where the coupler is configured to be used with larger gauge wire, e.g., 10 gauge or larger wire, it may be desirable to include more conductive material as the larger wire is designed to carry more current than smaller wire, e.g., 16 gauge wire. In addition, where larger wire such as 10 gauge wire is used, it may be desirable to include a conductive element on both the top and the base of the coupler to sandwich the large wire between the conductive elements. The conductive element can be a generally pure material, e.g., six-nines copper, or may be a mixture or combination of materials, e.g., a silver amalgam, copper-silver mixtures or the like. The material of the conductive element can be or can include nanoparticles, nanostructures or other similar materials if desired. It may be desirable to alter the materials used in the coupler depending on the type of electrical wire used, e.g., copper versus aluminum. It will be within the ability of the person of ordinary skill in the art, given the benefit of this disclosure, to select suitable materials for use in the conductive elements described herein.

Figure 4A:
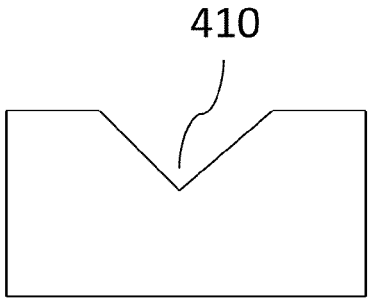
FIGS. 4A-4D are cross-sections of conductive elements or other components of the coupler having various different geometries, in accordance with certain examples.
Figure 4B:
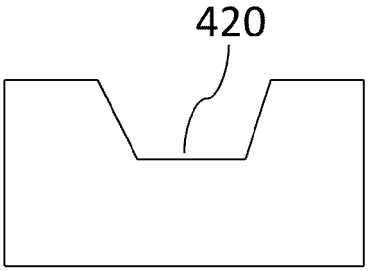
Figure 4C:
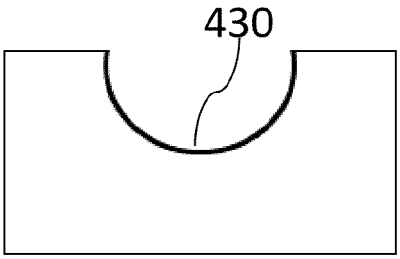
Figure 4D:
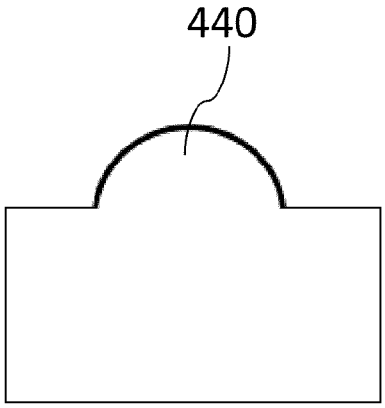

In certain examples and referring to FIGS. 4A-4D, the top, base, conductive element of all of them can be configured to provide a desired shape to receive the electrical wires. Referring to FIG. 4A, a side view of a conductive element, which can be in the base or the top, having a generally triangular shaped depression is shown. The depression 410 is designed be in physical contact with the electrical wire. Depending on the nature of the wire and the desired amount of surface area to be contacted, the cross-sectional shape of the conductive element can vary. For example and referring to FIGS. 4B and 4C, trapezoidal and semi-circular depressions are shown, respectively. In some embodiments, the diameter and shape of the conductive element can match that of the wire to be inserted into the coupler such that the lower half of the wire contacts the conductive element. Other shapes are also possible and will be readily selected by the person of ordinary skill in the art, given the benefit of this disclosure. In some instances, it may be desirable to include a projection on the top or the base that is designed to push against the wire when the top and the base of the coupler are engaged. One such configuration is shown in FIG. 4D, where a semi-circular projection 440 is shown. In operation, the projection 440 is designed to mate to a depression, such as depression 430. When a wire is inserted into the coupler and rests against the depression 430, the projection 440 would engage a top surface of the wire and force the wire to remain in contact with the depression 430 when the top of the coupler is mated to the base of the coupler.

In certain examples, where the conductive element comprise a depression or a projection as described in reference to FIG. 4A-4D, the top or the base or both may also comprise a similar shape. For example, where the conductive element is disposed as a film, the film can be disposed on as base comprising a depression such that the film would take the shape of the depression in the base of the coupler. A similar configuration would result is the conductive element was disposed on the top of the coupler.

In use of the coupler shown in FIGS. 1 and 2, an electrical wire would be inserted at one side or port of the coupler 100. The wire would typically be a single wire, e.g., a hot wire or a return wire, present in a wire bundle such as that commonly referred to as Romex® non-metallic shielded wire. Insulation around a portion of the wire would be removed, e.g., about 0.5-1 inch of insulation material is removed. The exposed portion of the wire is then inserted into one port of the coupler. A corresponding wire is inserted into the other port of the coupler after removal of insulation from the second wire. Where a hot wire is inserted into the first port, a hot wire of the second wire bundle would be inserted into the second port such that current is provided from hot wire through the conductive element and to the second hot wire. The fastener 130 is then tightened down to the base 110 to bias or force the top 120 of the coupler 110 against the base 110. This tightening acts to retain the wires within the coupler 110 and to force the wires into contact with the conductive element 150. In certain instances, the exposed electrical wire is positioned entirely within the housing and tightening of the top of the housing to the base of the housing sandwiches the exposed portion of the wire between the top and the base and provides contact with the conductive element. In this manner, an electrical connection between the two hot wires can be provided without physical coupling or any physical connection of the two hot wires. Where the exposed portions are contained within the coupler housing, an electrical box can be omitted which reduces cost and permits coupling of wires without the space constraints commonly imposed when electrical boxes are used. A similar connection can be made with the return wires using another coupler and the ground wires if desired. In some instances, the coupler 100 can also include a grounding plate on an outer surface where the ground wires contact the coupler to provide a grounded coupler housing. Examples of couplers that include grounding plates are described in more detail below.

In certain embodiments, fastening of the top to the base can be accomplished in many different manners depending on the configuration of the coupler. For example, the coupler can be designed with a base that includes threads configured to receive a screw in the top housing and which mating of the screw to the threads of the base is configured to bias the two exposed conductive portions of the electrical wires against the conductive element to provide the electrical coupling between the first and second electrical wires and to secure the first and second electrical wires within the device. In other configurations, male and female connectors can be used to couple the top of the coupler to the base of the coupler.

Figure 5:
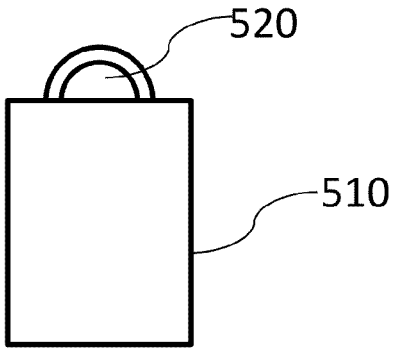
FIG. 5 is a side view of a coupler comprising a securing device, in accordance with certain examples.

In certain embodiments, the coupler may also include additional structural components on it to facilitate attachment of the coupler to a desired physical structure such as a joist, truss, wall stud of the like. Illustrative securing devices that can be used with the couplers described herein include nails, screws, double-sided tape, hook and loop fastener, adhesives, hooks and combinations thereof. In some embodiments, the coupler comprises a loop or opening that can receive a screw to secure the coupler to a physical structure. One such example is shown in FIG. 5. The coupler 510 comprises a securing device comprising an opening 520 that can receive a screw or nail to fasten the coupler 510 to a desired physical structure. The exact dimensions and cross-sectional shape of the securing device can vary depending on the intended use of the coupler and the location within a dwelling or building where the two electrical wires are coupled.

Figure 6:
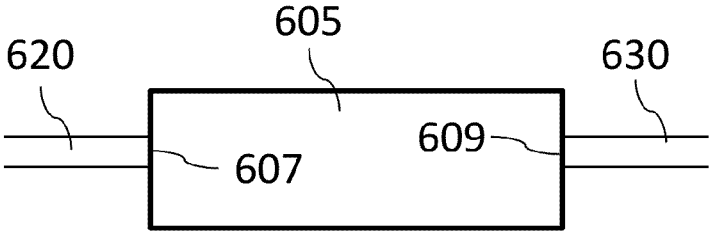
FIG. 6 is an illustration of a coupler designed to provide planar coupling of two wires, in accordance with certain examples.

In some examples, the coupler housing can be configured to couple wires in a generally planar manner where the two wires enter the coupler at ports on opposite ends of the coupler. One configuration of planar coupling is shown in FIG. 6. The coupler 605 comprises a first port 607 at one end and a second port 609 at an opposite end. A first electrical wire 620 is inserted into the port 607 and a second wire 630 is inserted into the second port 609. A conductive element (not shown) within the coupler 605 provides electrical coupling between the first wire 620 and the second wire 630.

Figure 7:
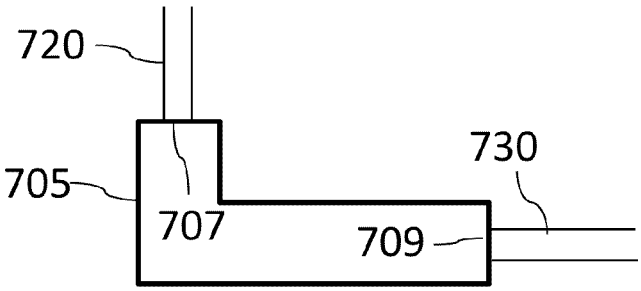
FIG. 7 is an illustration of a coupler designed to couple two wire at a non-planar angle, e.g., less than 180 degrees, in accordance with certain examples.

In certain embodiments, the wires can be coupled to each other in a non-planar manner. For example, the coupler can include one or more lateral, dorsal or ventral openings or ports that can receive an electrical wire. The terms dorsal and ventral are relative to the longitudinal axis of the coupler housing. Referring to FIG. 7, a coupler 705 comprises a first dorsal port 707 and a second port 709. A first electrical wire 720 is inserted into the dorsal port 707 and a second wire 730 is inserted into the second port 709. A conductive element (not shown) within the coupler 705 provides electrical coupling between the first wire 720 and the second wire 730. The conductive element may be angled, e.g., at 90 degrees, to provide the electrical coupling between the two wires 720 and 730.

Figure 8:
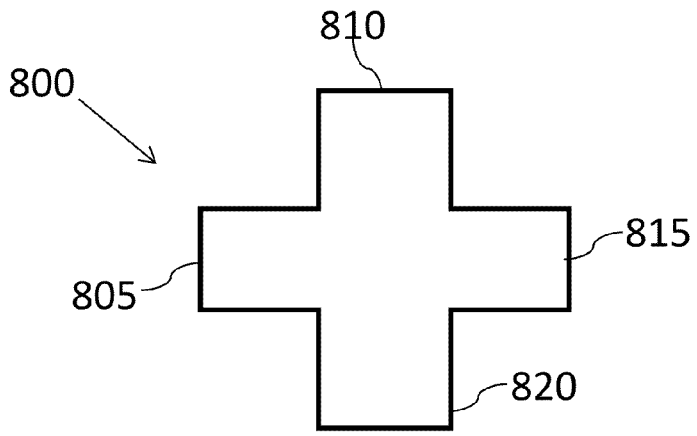
FIG. 8 is an illustration of a coupler designed to couple two or more wires, in accordance with certain examples.

In some examples, the coupler can include many different ports and any two ports can be selected by a user to provide the electrical coupling between the two wires. For example, a coupler 800 is shown in FIG. 8. The coupler 800 comprises first, second, third and fourth ports 805, 810, 815 and 820 respectively. Any two of the ports can be used to provide electrical coupling between two wires. If desired, more than two of the ports can be used to provide electrical coupling between three or more wires. For example, on open port can be used to connect a third wire to an existing wire pair to tap into current from the wire run. A coupler with a plurality of ports can act as a junction box without the need to have a separate electrical box or any direct physical connection between the electrical wires.

In certain embodiments, the top of the coupler can be designed to irreversibly engage to the base of the coupler. For example, the base can include one-way threads or thread locking compound so that when the fastener is engaged to the threads it generally cannot be removed without damage to the coupler. Such a configuration may be desirable to prohibit multiple uses of the coupler and/or use of the same exposed wire portions as those portions may exhibit deformation when the top and the base are engaged to each other. In addition, the physical contact between the conductive element and the exposed wire may be highest during first use and prior to any oxidation of the wire surface.

In certain embodiments, the couplers described herein can include one or more external ports or connections designed to couple to a corresponding port or receptacle on an electrical device such as, for example, an electrical switch, an electrical outlet, a lighting fixture, or an electrical socket. In operation, the coupler would first be coupled to a hot wire and a second coupler could be coupled to the return wire. A first external port of a coupler can be electrically coupled to the hot wire through a first conductive element. An external port of the second coupler can be electrically coupled to the return wire. Each of the couplers can be plugged into an electrical device to provide power to that device. This plug and play configuration provides for rapid wiring of electrical devices and permits use of the electrical device without any electrical box as all conductive portions of the wires, couplers and the electrical device are positioned within insulated housings. By including external ports on the couplers described herein, the time to wire electrical devices is decreased substantially and secure electrical coupling between the hot and return wires and the electrical devices are provided in a rapid manner.

Figure 9:
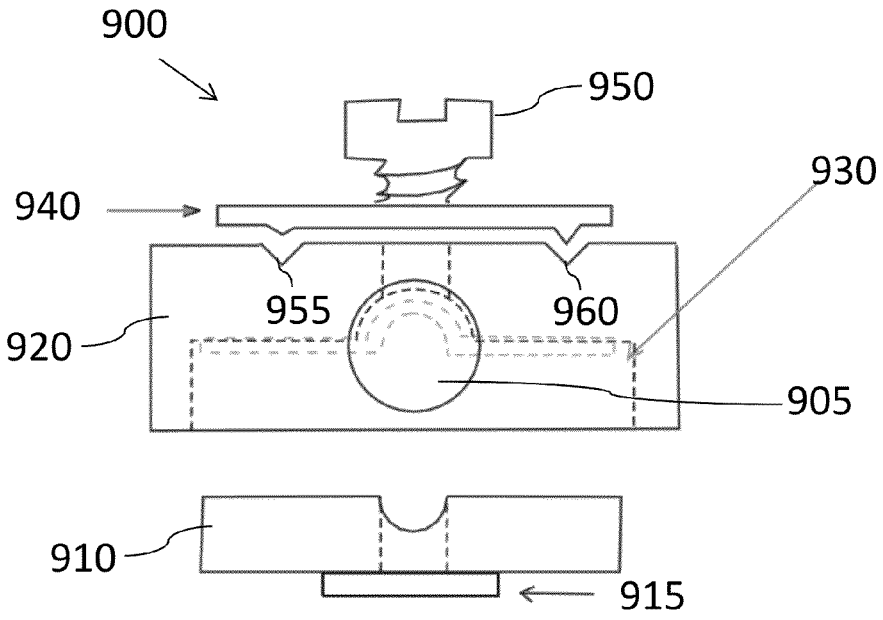
FIG. 9 is another illustration of a coupler configured to couple two wires, in accordance with certain examples.

In certain embodiments and referring to FIG. 9, a side view of a coupler is shown. The coupler 900 comprises a base 910, a top 920, a conductive element 930 that is attached to the top 920, a grounding plate 940 that can engage ground wires and a fastening screw 950 that is configured to mate the top 920 with the base 910. The base 910 also includes a stop plate 915 configured to stop tightening of the screw 950. In use of the coupler 900, a wire is inserted into the opening 905 with some portion of the wire having the insulation removed. The top 920 is then tightened to the base 910 by turning of the screw 950 until the tip of the screw contacts the stop plate 915 which has been threaded into threads on the base 910. If desired, the stop plate 915 may include its own threads designed to engage threads of the fastening screw 950 to retain the top 920 to the base 910. When the top 920 is engaged to the base 910, the conductive element 930 contacts the exposed portion of the inserted wire, and the top 920 is sized and arranged to slide around and over the peripheral edges of the base 910. This arrangement provides for more of a fluid-tight seal between the top 920 and base 910 which can aid in protecting the wire from environmental damage and/or oxidation.

In certain embodiments, the top 920 can include grooves or depressions 955, 960 in an upper surface that are configured to receive a ground wire. For example, a ground wire can be inserted into the groove and the grounding plate 940 is pressed against the ground wire in the groove 955 or 960 when the fastener 950 is tightened.

Figure 10A:
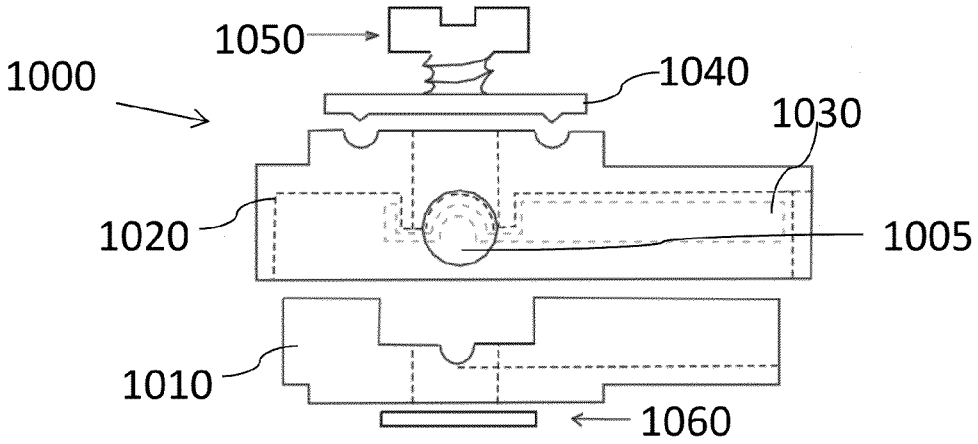
FIGS. 10A and 10B are illustrations of a coupler configured to receive three wires, in accordance with certain examples.
Figure 10B:
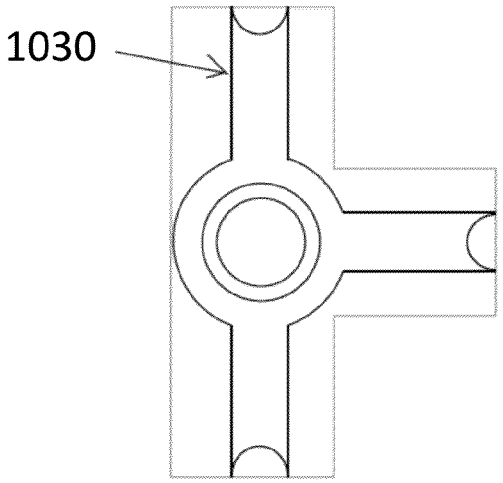

In certain embodiments and referring to FIGS. 10A and 10B, a side view of a coupler configured to receive three wires is shown. The coupler 1000 comprises a base 1010, a top 1020, a first conductive element 1030 which is attached to the top 1020, an optional grounding plate 1040 that can engage ground wires and a fastening screw 1050 that is configured to mate the top 1020 with the base 1010 through a plate 1060. In use of the coupler 1000, a hot wire is inserted into the opening 1005 with some portion of the wire having the insulation removed. The top 1020 is then tightened to the base 1010 by turning of the screw 1050 until the screw engages threads in the plate 1060 and is generally hand tight. When the top 1020 is engaged to the base 1010, the conductive element 1030 contacts the exposed portion of the hot wire. In certain embodiments, the top 1020 can include grooves or depressions in an upper surface that are configured to receive a ground wire. For example, a ground wire can be inserted into the groove and a grounding plate (not shown) is pressed against the ground wire in the groove when the fastener 1050 is tightened. The three-wire coupler 1000 is generally T-shaped as shown in FIG. 10B and includes four ports each of which can receive an electrical wire. The conductive element 1030 takes the same general shape as the housing of the coupler 1000 to provide electrical coupling of the three wires. While the conductive element 1030 is shown as being present in the top plate 1020, it may instead be present in the bottom plate 1010 or both the top and bottom plates.

Figure 11A:
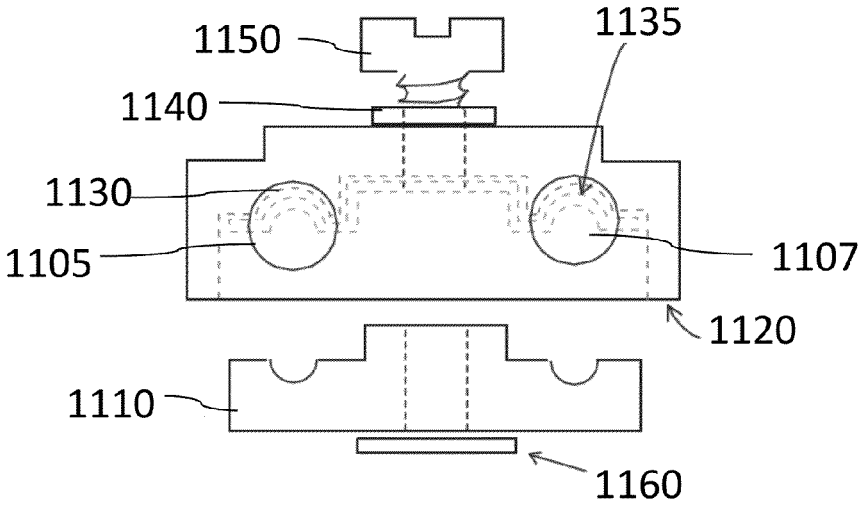
FIGS. 11A and 11B are illustrations of a coupler configured to receive four wires, in accordance with certain examples.
Figure 11B:
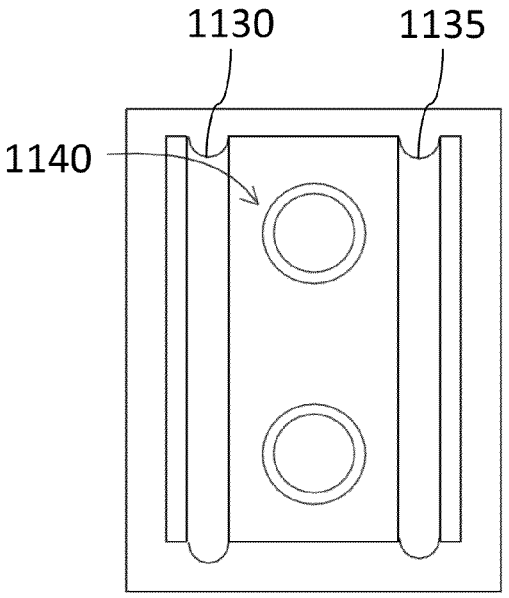

In certain embodiments and referring to FIGS. 11A and 11B, a side view of a coupler configured to receive four wires is shown. The coupler 1100 comprises a base 1110, a top 1120, a first conductive element 1130 and a second conductive element 1135 each of which is attached to the top 1120, an optional grounding plate 1140 that can engage ground wires and a fastening screw 1150 that is configured to mate the top 1120 with the base 1110 through a plate 1160. In use of the coupler 1100, a hot wire is inserted into the opening 1105 with some portion of the wire having the insulation removed. A return wire is inserted into the opening 1107 with some portion of the wire having the insulation removed. The top 1120 is then tightened to the base 1110 by turning of the screw 1150 until the screw engages threads in the plate 1160 and is generally hand tight. When the top 1120 is engaged to the base 1010, the first conductive element 1030 contacts the exposed portion of the hot wire and the second conductive element 1035 contact the exposed portion of the return wire. The first and second conductive elements are electrically isolated from each other such that current does not flow between them. In certain embodiments, the top 1120 can include grooves or depressions in an upper surface that are configured to receive a ground wire. For example, a ground wire can be inserted into the groove and a grounding plate (not shown) is pressed against the ground wire in the groove when the fastener 1150 is tightened. The four-wire coupler 1100 is generally square-shaped as shown in FIG. 11B and includes four ports each of which can receive an electrical wire. The conductive elements 1030 and 1035 are generally configured as planar shaped or rod-shaped and run from one side of the housing to another. While the conductive elements 1130 and 1135 are shown as being present in the top plate 1120, they may instead be present in the bottom plate 1110 or both the top and bottom plates. In some examples, one conductive element may be in the top plate and the other conductive element may be in the bottom plate.

Figure 12:
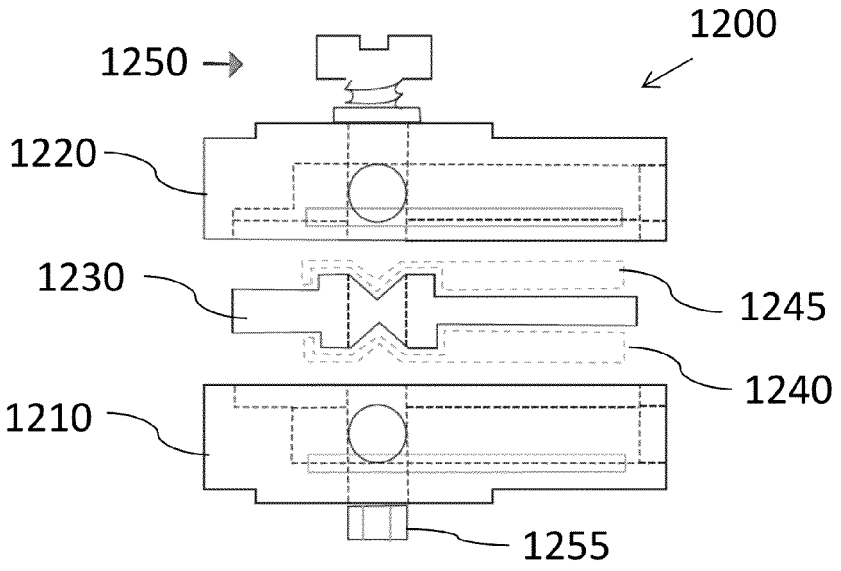
FIG. 12 is an illustration of a coupler configured to receive six wires, in accordance with certain examples.
Figure 13:
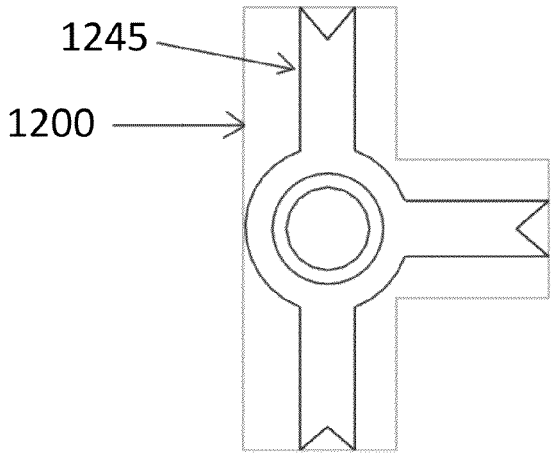
FIG. 13 is a top view of the coupler of FIG. 12, in accordance with certain examples.

In certain embodiments, a coupler configured to receive six wires is shown in FIG. 12. The coupler 1200 comprises a base 1210, a top 1220, an insert 1230 comprising a first conductive element 1240 and a second conductive element 1245, a fastener 1250 and a nut 1255 designed to receive threads on the fastener 1250. A top view of the device is shown in FIG. 13 and shows the T-shaped nature of the coupler 1200 having six total ports with a pair of ports on each end of the coupler and one pair of ports on the end of the T-shaped portion of the coupler 1200. In use of the coupler 1200, a hot wire and a return wire from one electrical cable can be inserted into a port on each side of the coupler 1200. If desired, the base of the coupler can be painted or colored black to provide some visual guidance that the hot wire of the electrical cable, which typically includes black insulation, should be inserted into the lower port on each side of the coupler 1200. After insertion of the desired number of wires, the fastener 1250 is tightened down to the nut 1255 to bias the base 1210, the top 1220 and the insert 1230 together. Such biasing or forcing of the components together acts to retain the wires within the coupler 1200 and provides physical contact of the wires with one of the conductive elements 1240 and 1245. It will be recognized by the person of ordinary skill in the art, given the benefit of this disclosure, that not all of the ports of the coupler 1200 need to be used at any one time. For example, it may be desirable to leave one of the port pairs open to tap into the circuit for future use. In addition, it may be desirable to include additional conductive elements on the top, the base or both to sandwich the wires between two or more conductive elements. In the alternative, it may be desirable to include non-conductive elements, or elements which are less conductive than the conductive elements, on the top, the base or both.

Figure 14:
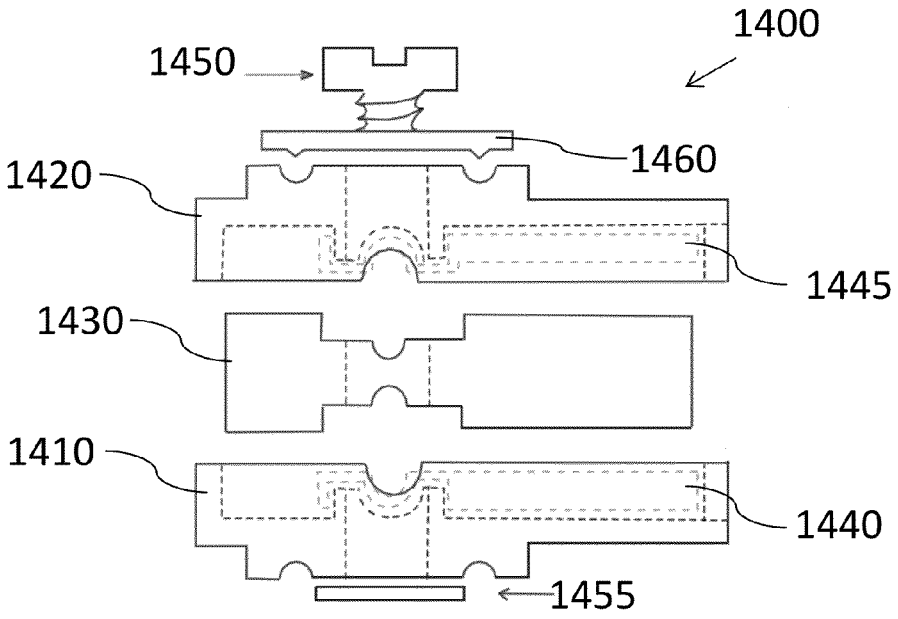
FIG. 14 is an illustration of another coupler configured to receive six wires, in accordance with certain examples.
Figure 15:
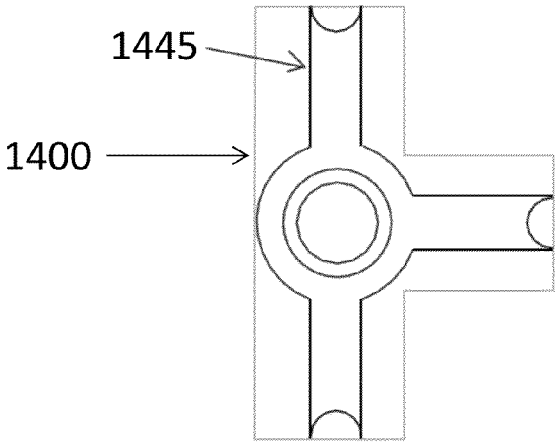
FIG. 15 is a top view of the coupler of FIG. 14, in accordance with certain examples.

In certain examples, another coupler configured to receive six wires is shown in FIG. 14. The coupler 1400 comprises a base 1410 comprising a conductive element 1440, a top 1420 comprising a conductive element 1445, an insert 1430, a fastener 1450 and a plate 1455 comprising internal threads to receive threads on the fastener 1450. A top view of the device is shown in FIG. 14 and shows the T-shaped nature of the coupler 1400 having six total ports with a pair of ports on each end of the coupler and one pair of ports on the end of the T-shaped portion of the coupler 1400. In use of the coupler 1400, a hot wire and a return wire from one electrical cable can be inserted into a port on each side of the coupler 1400. If desired, the base of the coupler can be painted or colored black to provide some visual guidance that the hot wire of the electrical cable, which typically includes black insulation, should be inserted into the lower port on each side of the coupler 1400. After insertion of the desired number of wires, the fastener 1450 is tightened down to the plate 1455 to bias the base 1410, the top 1420 and the insert 1430 together. Such biasing or forcing of the components together acts to retain the wires within the coupler 1400 and provides physical contact of the hot wires with the first conductive element 1440 and physical contact of the return wires with the second conductive element 1445. It will be recognized by the person of ordinary skill in the art, given the benefit of this disclosure, that not all of the ports of the coupler 1400 need to be used at any one time. For example, it may be desirable to leave one of the port pairs open to tap into the circuit for future use. In addition, it may be desirable to include additional conductive elements on the insert to sandwich the wires between two or more conductive elements. In the alternative, it may be desirable to include non-conductive elements, or elements which are less conductive than the conductive elements, on the insert. While the openings shown in the plate 1420 are shown as being semi-circular, if desired the openings may take the same general shape shown in reference to FIG. 12, e.g., circular.

In certain embodiments, the coupler 1400 also includes a grounding plate 1460 on the top 1420. Ground wires can be inserted between the top 1420 and the grounding plate 1460. Tightening of the fastener 1450 to the plate 1455 acts to retain the ground wires between the grounding plate 1460 and the top 1420.

In certain examples, the embodiments described in reference to FIGS. 12-15 may include conductive elements, tops and bases similar to those described in reference to the embodiments of FIGS. 1-11, e.g., the conductive element may include a metal such as copper and the tops, bases and inserts can be produced using one or more plastics or other insulating materials.

Figure 16:
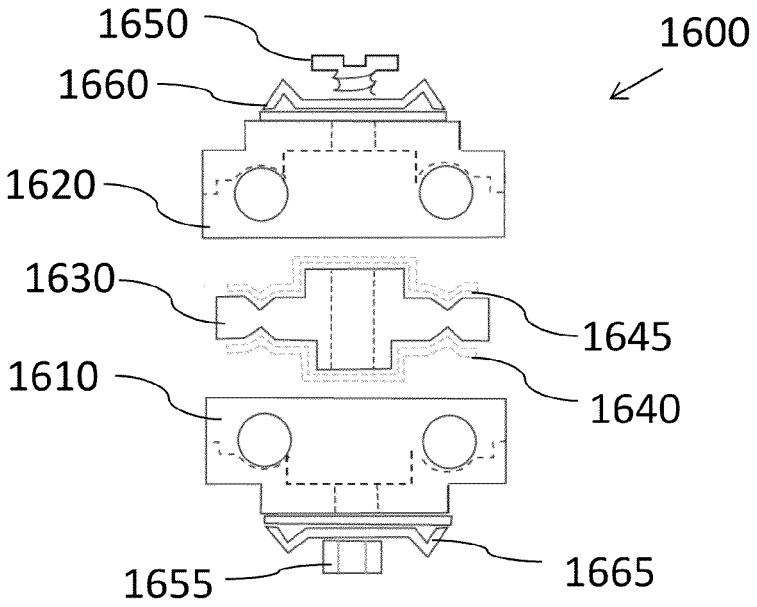
FIG. 16 is illustration of a coupler configured to receive eight wires, in accordance with certain examples.
Figure 17:
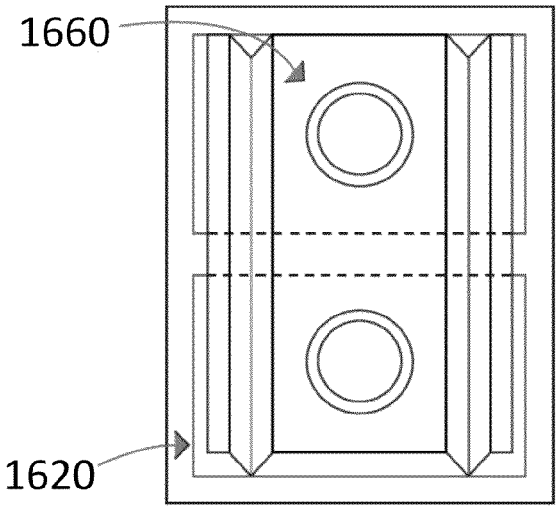
FIG. 17 is top view of the coupler of FIG. 16, in accordance with certain examples.

In certain embodiments, a coupler configured to receive eight wires is shown in FIG. 16. The coupler 1600 comprises a base 1610, a top 1620, an insert 1630 comprising a first conductive element 1640 and a second conductive element 1645, a fastener 1650 and a nut 1655 designed to receive threads on the fastener 1650. A top view of the device is shown in FIG. 17 and shows the square shape nature of the coupler 1600 having eight total ports with two pair of ports on each end of the coupler 1600. In use of the coupler 1600, a hot wire and a return wire from one electrical cable can be inserted into a port on each side of the coupler 1600. If desired, the base of the coupler can be painted or colored black to provide some visual guidance that the hot wire of the electrical cable, which typically includes black insulation, should be inserted into the lower port on each side of the coupler 1600. After insertion of the desired number of wires, the fastener 1650 is tightened down to the nut 1655 to bias the base 1610, the top 1620 and the insert 1630 together. Such biasing or forcing of the components together acts to retain the wires within the coupler 1600 and provides physical contact of the wires with one of the conductive elements 1640 and 1645. It will be recognized by the person of ordinary skill in the art, given the benefit of this disclosure, that not all of the ports of the coupler 1600 need to be used at any one time. For example, it may be desirable to leave one of the port pairs open to tap into the circuit for future use. In addition, it may be desirable to include additional conductive elements on the top, the base or both to sandwich the wires between two or more conductive elements. In the alternative, it may be desirable to include non-conductive elements, or elements which are less conductive than the conductive elements, on the top, the base or both.

In certain embodiments, the coupler 1600 also includes a first grounding plate 1660 on the top 1620 and a second grounding plate 1665 on the base 1610. Ground wires can be inserted between the top 1620 and the grounding plate 1660 and/or the base 1610 and the grounding plate 1665. Tightening of the fastener 1650 to the nut 1655 acts to retain the ground wires between the grounding plate 1660 and the top 1620 and the grounding plate 1665 and the base 1610.

Figure 18:
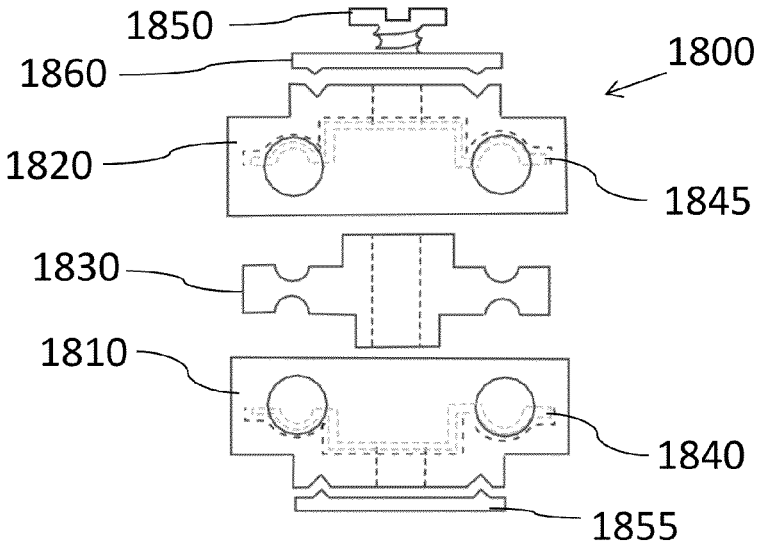
FIG. 18 is illustration of another coupler configured to receive eight wires, in accordance with certain examples.
Figure 19:
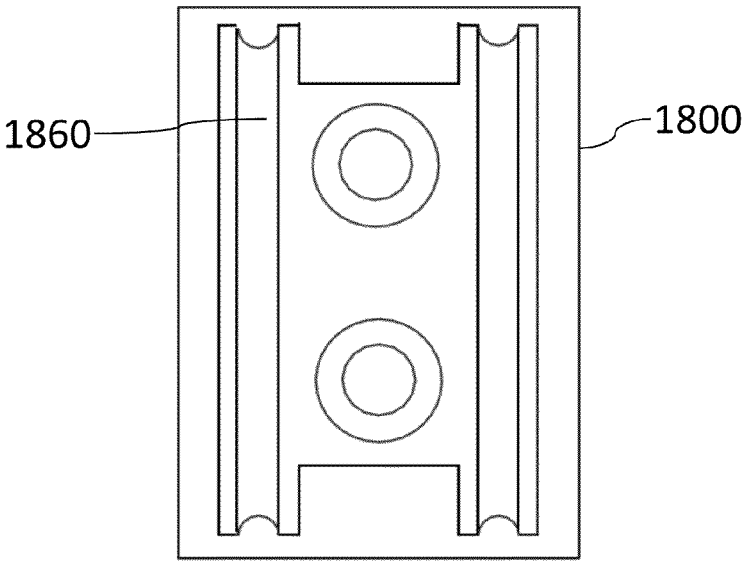
FIG. 19 is a top view of the coupler of FIG. 18, in accordance with certain examples.

In certain examples, another coupler configured to receive eight wires is shown in FIG. 18. The coupler 1800 comprises a base 1810 comprising a conductive element 1840, a top 1820 comprising a conductive element 1845, an insert 1830, a fastener 1850 and a plate 1855 comprising internal threads to receive threads on the fastener 1850. A top view of the device is shown in FIG. 19 and shows the square-shaped nature of the coupler 1800 having eight total ports with two pair of ports on each end of the coupler and one pair of ports on the end of the T-shaped portion of the coupler 1800. In use of the coupler 1800, a hot wire and a return wire from one electrical cable can be inserted into a port on each side of the coupler 1800. If desired, the base 1810 of the coupler can be painted or colored black to provide some visual guidance that the hot wire of the electrical cable, which typically includes black insulation, should be inserted into the lower port on each side of the coupler 1800. After insertion of the desired number of wires, the fastener 1850 is tightened down to the plate 1855 to bias the base 1810, the top 1820 and the insert 1830 together. Such biasing or forcing of the components together acts to retain the wires within the coupler 1800 and provides physical contact of the hot wires with the first conductive element 1840 and physical contact of the return wires with the second conductive element 1445. It will be recognized by the person of ordinary skill in the art, given the benefit of this disclosure, that not all of the ports of the coupler 1800 need to be used at any one time. For example, it may be desirable to leave one of the port pairs open to tap into the circuit for future use. In addition, it may be desirable to include additional conductive elements on the insert to sandwich the wires between two or more conductive elements. In the alternative, it may be desirable to include non-conductive elements, or elements which are less conductive than the conductive elements, on the insert.

In certain embodiments, the coupler 1800 also includes a first grounding plate 1860 on the top 1820 and a second grounding plate 1865 on the base 1810. Ground wires can be inserted between the top 1820 and the grounding plate 1860 and/or the base 1810 and the grounding plate 1865. Tightening of the fastener 1850 to the nut 1855 acts to retain the ground wires between the grounding plate 1860 and the top 1820 and the grounding plate 1865 and the base 1810.

In certain examples, the embodiments described in reference to FIGS. 16-19 may include conductive elements, tops and bases similar to those described in reference to the embodiments of FIGS. 1-15, e.g., the conductive element may include a metal such as copper and the tops, bases and inserts can be produced using one or more plastics or other insulating materials.

In certain examples, the couplers described herein can be present in a kit. In some embodiments, the kit can include an electrical device configured to couple to coupler, the electrical device comprising a first electrical connector and a second electrical connector each configured to couple to a terminal on the coupler to provide an electrical connection between the first connector of the electrical device and a first terminal of the coupler that is electrically coupled to the first conductive element and to provide an electrical connection between the second connector of the electrical device and a second terminal of the coupler that is electrically coupled to the second conductive element, in which the first electrical connector and the second electrical connector are enclosed within the coupler device when they are coupled to the coupler.

In some embodiments, the kit can include a cover configured to encase the coupler. In other embodiments, the coupler of the kit further comprises an integral fastener configured to fasten the housing to a physical structure. In additional embodiments, the kit can include a fastener configured to engage to the coupler and fasten the coupler to a physical structure. In some examples, the kit can include a plurality of the couplers packaged together. In other examples, at least two of the couplers of the kit are sized and arranged differently. In additional embodiments, at least two of the couplers are sized and arranged to accept different gauges of wire. In further examples, the kit can include instructions for using the coupler to electrically couple two non-metallic sheathed electrical cables. In some embodiments, the kit can include instructions for using the coupler to electrically couple the coupler to an electrical device. In other examples, the kit can include at least one insert configured to be placed between the top and the base. In certain embodiments, the kit can include at least one grounding plate configured to engage the housing of the coupler. In other embodiments, the kit can include instructions for using the coupler to electrically couple two electrical wires without any physical contact of the electrical wires. In further examples, the kit can include a plurality of couplers packaged together, in which at least one of the coupler is sized and arranged to receive a first gauge wire and wherein at least one second coupler is sized and arranged to receive a different gauge wire than the first gauge wire. In some embodiments, the kit can include a potting compound.

In certain examples, the couplers described herein can be used to provide for boxless connection of wires. For examples, the coupler can be used by inserting an exposed portion of the first electrical wire into one port of the housing of the coupler. An exposed portion of a second electrical wire can be inserted into a second port of the housing. The top of the non-conductive housing can be tightened to the base of the non-conductive housing to provide contact between the exposed portion of the first electrical wire with the conductive element and contact between the exposed portion of the second electrical wire with the conductive element to provide the electrical coupling between the first and second electrical wires. In some examples, the electrical coupling is provided without physical contact between the exposed portions of the first and second electrical wires. In other examples, tightening of the top to the base encloses the exposed conductive portions of the wires within the coupler. In certain embodiments, a cover can be placed on the electrical coupler after insertion of the wires. In other embodiments, the electrical coupler with the inserted wires can be attached to a physical structure. In certain instances, a potting compound can be disposed on the electrical coupler after insertion of the wires. In other examples, an additional set of electrical wires can be coupled to coupling ports on the electrical connector.

In certain examples, the exact size of the couplers described herein can vary depending on the type and nature of the wire to be used with the coupler. In embodiments where a 2-wire coupler is provided, the coupler can be about 1-2 inches long by about 1-2 inches wide, e.g., about 1 inch long by about 1 inch wide. In embodiments where a 3-wire of 4-wire coupler is provided, the coupler can be about 1-2.5 inches long by about 1-2.5 inches wide, e.g., about 1 inch long by about 1¼ inches wide. In embodiments where a 6-wire coupler is provided, the coupler can be about 1-3 inches long by about 1-2 inches wide, e.g., about 1⅜ inches long by about 1¼ inches wide. In embodiments where an 8-wire coupler is provided, the coupler can be about 1-3 inches long by about 1-2 inches wide, e.g., about 1" long by about 1¼ inches wide. The exact thickness of the couplers can also vary and those couplers used with an insert will be generally thicker than those used without an insert. In some embodiments, the overall height or thickness of the coupler can vary from about 0.5 inches inch to about 4 inches, more particularly about 1 inch to about 3 inches, for example, about 1 inch to about 2 inches. Additional dimensions, shapes and form factors for the couplers will be readily selected by the person of ordinary skill in the art, given the benefit of this disclosure.

In certain embodiments, the coupler can be configured to be placed in a wet or moist environment. If desired, the coupler can be wrapped or shielded with materials to seal the coupler from the ambient. In some embodiments, a moisture shield can be added to the wire shielding and/or the coupler to provide a fluid tight seal between the coupler and any surrounding wrap to provide for further removal from the moisture.

In some embodiments, the base of the couplers described herein can be configured with one or more fasteners designed to couple the base of the coupler to a wall stud. In use, the fastener of the base is nailed or screwed into the wall stud to attach the base to the wall stud. Wire can be inserted into the openings of the base and the top can then be tightened down to retain the wires in the coupler and provide the electrical coupling. In an alternative use, the coupler can be used to provide electrical coupling of the wires by engaging the top to the base and then the assembly can be nailed or fastened to a wall stud after the wires have been retained by the coupler. In certain configurations, the fastener may be placed through a hole or opening molded into the base, whereas in other examples, the fastener may be attached to the base through a plate or adapter designed to couple to the base, e.g., a plate that can engage the bottom of the base and include threads configured to receive the fastener in the top of the coupler. If desired the fastener opening could instead be placed on the top of the coupler or on any insert designed to go between the top and the base of the coupler.

Figure 20:
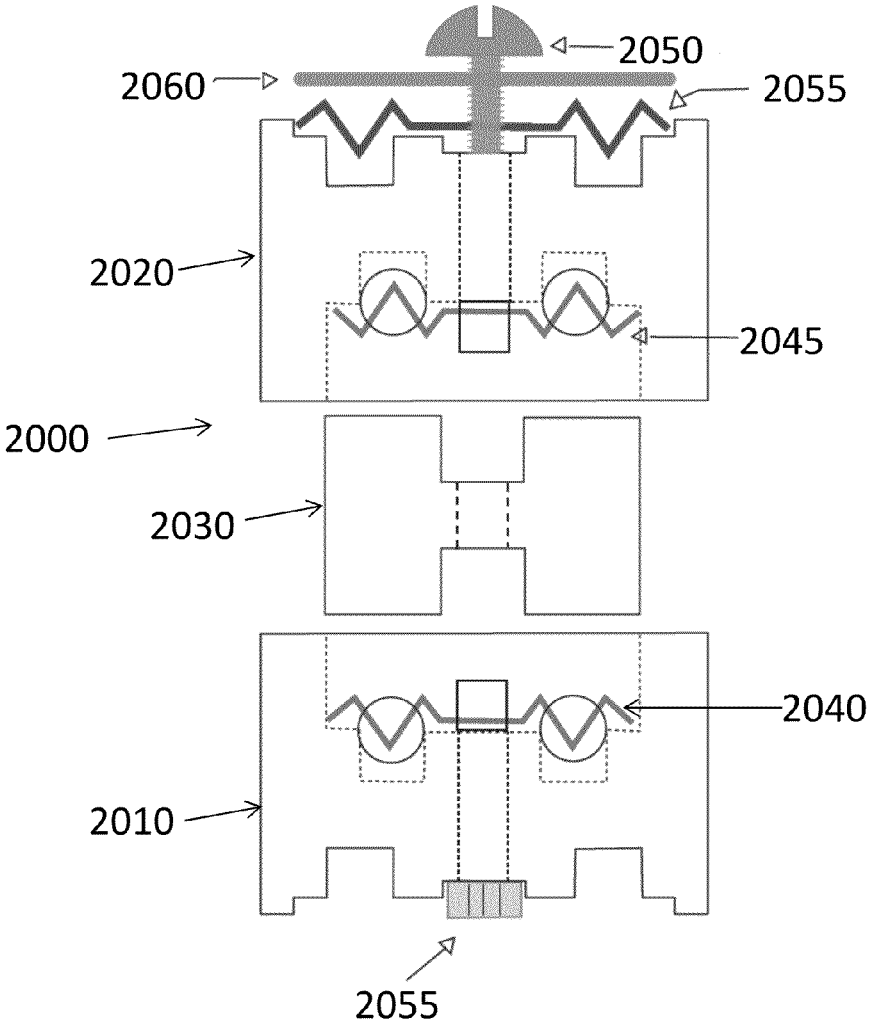
FIG. 20 is another embodiment of a coupler, in accordance with certain examples.

In certain examples, another coupler configured to receive six or eight wires is shown in FIG. 20. The coupler 2000 comprises a base 2010 comprising a conductive element or plate 2040, a top 2020 comprising a conductive element or plate 2045, an insert 2030, a fastener 2050 and threads 2055 configured to receive threads on the fastener 2050, e.g., an embedded nut comprising threads that can receive threads on the shaft of the fastener 2050. A plate 2060 is shown that can be used to retain the ground wires between the plate 2060 and an element 2055. The insert 2030 may include non-conductive materials so that when the top 2020 and the bottom 2010 are coupled, the conductive element 2045 does not contact the conductive element 2040. Each of the elements 2040, 2045 and 2055 can be produced using aluminum, copper or other materials. In some instances, the elements 2040 and 2045 are copper, and the element 2055 may be aluminum. In use of the coupler 2000, a hot wire and a return wire from one electrical cable or wire bundle can be inserted into a port or aperture on each side of the coupler 2000. If desired, the base 2010 of the coupler 2000 can be painted or colored black to provide some visual guidance that the hot wire of the electrical cable, which typically includes black insulation, should be inserted into the lower port on each side of the coupler 2000. After insertion of the desired number of wires, the fastener 2050 is tightened down to the element 2055 to bias the base 2010, the top 2020 and the insert 2030 together. Such biasing or forcing of the components together acts to retain the wires within the coupler 2000 and provides physical contact of the hot wires with the first conductive element 2040 and physical contact of the return wires with the second conductive element 2045. The ground wires are held between the plate 2060 and the element 2055. It will be recognized by the person of ordinary skill in the art, given the benefit of this disclosure, that not all of the ports of the coupler 2000 need to be used at any one time. For example, it may be desirable to leave one of the port pairs open to tap into the circuit for future use. In addition, it may be desirable to include additional conductive elements on the insert to sandwich the wires between two or more conductive elements. In the alternative, it may be desirable to include non-conductive elements, or elements which are less conductive than the conductive elements, on the insert.

In certain examples, the device 2000 can be used with many different sizes of wires. For example, as the plate 2040 is pressed against an inserted wire, the inserted wire first contacts the raised part of the plate 2040. As the fastener 2050 is further tightened, the plate 2040 is pressed further against insert 2030 and additional force is provided on the inserted wire that is sandwiched between the plate 2040 and the insert 2030. Further tightening of the fastener 2050 forces the V-shape in plate 2040 to generally flatten out against the flat surface of the insert 2030 and provide for additional surface contact between the inserted wire and the plate 2040. Depending on the gauge of the wire, the degree to which the plate 2040 may flatten out can vary, but desirably the plate flattens out an effective amount to securely retain the wire and provide sufficient electrical coupling between the inserted wire and the plate 2040. A similar manner of electrically coupling a wire to a conductive element of the coupler may be performed with any of the other couplers described herein to provide for improved electrical coupling between the plates and the inserted wires.

Figure 21:
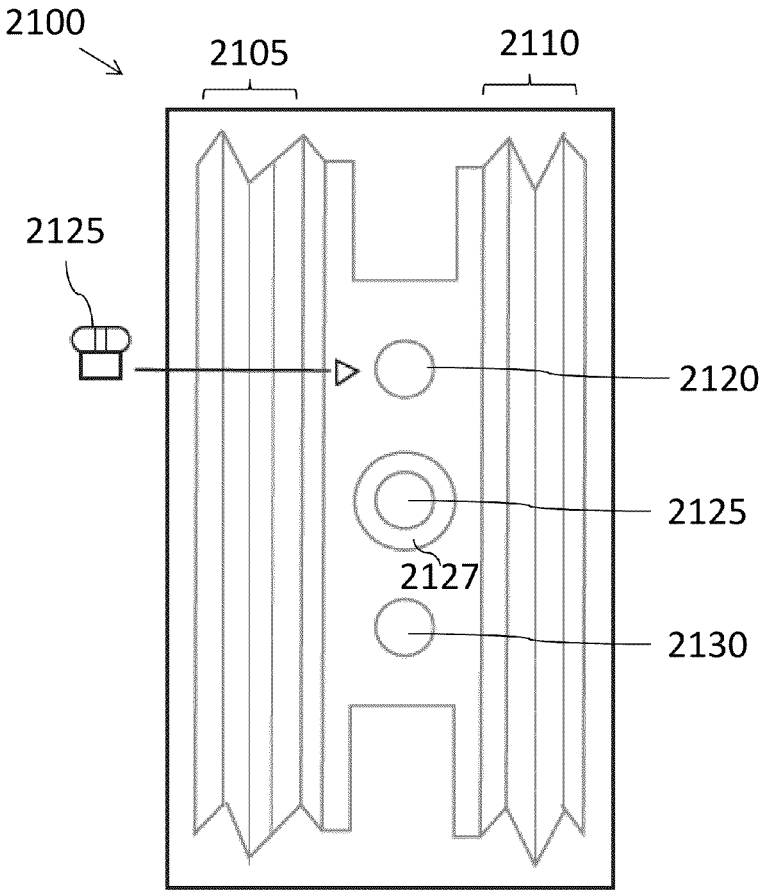
FIG. 21 is a top view of a conductive element or plate, in accordance with certain examples.

Referring now to FIG. 21, a top view of conductive element that can be used in the couplers described herein is shown. The element 2100 is shown to include depressions 2105, 2110 which can be sized and arranged to receive a certain gauge of wire. The element 2100 also includes apertures 2120, 2125 and 2130. Apertures 2120 and 2130 can be configured to receive a plastic nut, insert or bolt 2105 to retain the element 2100 to a top portion or a bottom portion of the coupler. The aperture 2125 is generally sized and arranged to permit passage of the fastener through it and may include an inner portion 2127 that is generally non-conductive and electrically isolates the fastener shaft (not shown) from the element 2100. In certain embodiments, a gap or opening may exist above the plate adjacent to opening 2125 such that current can flow to the fastener (and to ground) in the event of arcing. For example, a small air space may separate the top surface of the copper plate 2100 and the fastener (not shown) such that any unwanted arc or discharge can flow from the plate 2100 to the fastener and to ground.

Figure 22:
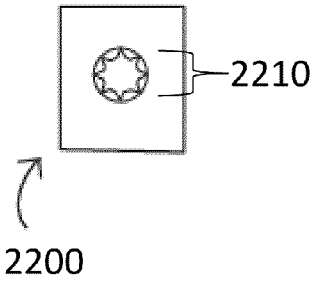
FIG. 22 is a side view of an insert that can be coupled to the coupler to deter removal of wires inserted into the coupler, in accordance with certain examples.

In certain embodiments, the body of the couplers described herein may include a device that is configured to deter removal of the wire from the coupler once the wire is inserted into the coupler. Referring to FIG. 22, an insert 2200 is shown that includes a plurality of teeth or inward projections 2210 projecting into the page of the figure. The teeth 2210 are configured to permit insertion of a wire into the direction of the page but generally deter removal of the wire if the wire is pulled in a direction away from the figure. In operation, the teeth can grab onto the wire insulation, or otherwise engage the wire insulation with a high friction force, and may be sized and arranged so that they do not contact the conductive portion of the wire but instead become embedded in the insulation or provide a force on the insulation to deter removal of the wire from the coupler. Where couplers include such devices as shown in FIG. 22, the insert 2200 may be coupled to a top plate or a bottom plate prior to insertion of any wires. For example, in the embodiment of FIG. 20, four inserts can be coupled to each side of the coupler and another four inserts can be coupled to the other side of the coupler. In some instances, the insert 2200 can be slid into a groove in the housing of the top or base of the coupler and is generally held in place by a friction fit. The opening of the insert 2220 may generally align with the aperture of the top or base portion of the couplers. In other instances, the insert may act to prevent any electrical wires from coming into contact with any surfaces outside the coupler, may prevent an individual from contacting some exposed portion of the conductors when the coupler is present in its use environment or may otherwise prevent any electrical discharge outside of the coupler.

In other instances, instead of teeth, the coupler can include thermoplastic materials or adhesives at the edges of the body, rubber materials, elastomeric materials or other materials which can generally contact the wire insulation and assist in retaining the wire once inserted into the coupler. The adhesives or thermoplastic materials may be heated after the top, insert and base are coupled to assist in retention of the wire within the coupler. In additional configurations, the body may include slidable or rotatable devices, e.g., hooks, loops or other devices, that can be positioned around the wire once the wire is inserted into the coupler. Additional mechanisms for assisting the couplers in retaining the wires will be readily selected by the person of ordinary skill in the art, given the benefit of this disclosure.

In some embodiments, the material of the insert can be sized and arranged such that it will generally deter insertion of a wire which in turns deters removal of the wire. The insert can include flaps or openings that may open to different degrees depending on the diameter of the wire. The insert may assist in retaining one wire in the coupler, prior to tightening of the fastener, while another wire is subsequently inserted into the coupler.

In certain embodiments, the insert of FIG. 22 may be integral to the coupler, e.g., at the side of the coupler, without the need to couple a separate insert to the coupler. If desired, the insert (or the material of the insert where the insert is integral) may be covered with a knock-out that may cover the wire opening to the top or base. The knock-out can be removed to leave the teeth or other material of the insert exposed.

In certain embodiments, the couplers described herein may be configured so a single coupler can be used with many different gauges of wire, e.g., 12 gauge-20 gauge. For larger diameter wires, e.g., 12-gauge, the top plate would not be compressed as close to the bottom plate. For smaller diameter wires, e.g., 20-gauge, the top plate would be compressed closer to the bottom plate to retain the smaller diameter wire within the coupler. Any of the configurations described herein may be used to couple different gauges of wire if desired and if such coupling meets electrical codes. The material of the insert 2200 can be sized and arranged to receive and assist in retaining the smaller 20 gauge wire and the larger 12 gauge wire in this example without the need of using inserts of different sizes or couplers configured for different size wires.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A device configured to provide electrical coupling between wires of a first non-metallic sheathed electrical cable and wires of a second non-metallic sheathed electric cable without physically connecting hot wires and return wires of the first and second non-metallic sheathed electrical cables, the device comprising:

a non-conductive housing comprising a base and a top configured to releasably engage the base to secure the first and second electrical wires in the housing; and a first conductive element disposed in the housing and configured to engage an exposed portion of a hot wire from the first non-metallic sheathed electrical cable at a first side of the housing and configured to engage an exposed portion of a hot wire from the second non-metallic sheathed electrical cable at a second side of the housing;

a second conductive element disposed in the housing and configured to engage an exposed portion of a return wire from the first non-metallic sheathed electrical cable at the first side of the housing and configured to engage an exposed portion of a return wire from the second non-metallic sheathed electrical cable at the second side of the housing;

in which the housing further comprises a grounding plate on the housing that is configured to receive a ground wire from the first non-metallic sheathed electrical cable and a ground wire from the second non-metallic sheathed electrical cable; and in which the top of the housing comprises a fastener configured to bias the exposed conductive portions of the hot wires against the first conductive element and to bias the exposed conductive portions of the return wires against the second conductive element to provide the electrical coupling between the hot wire of the first non-metallic sheathed electrical cable and the hot wire of the second non-metallic sheathed electrical cable and to provide electrical coupling between the return wire of the first non-metallic sheathed electrical cable and the return wire of the second non-metallic sheathed electrical cable.

2. The device of claim 1, in which the housing is color-coded to provide visual guidance for insertion of the hot wires into the device.

3. The device of claim 2, in which the housing is color-coded to provide visual guidance for insertion of the return wires into the device.

4. The device of claim 1, in which the base comprises a first connector configured to mate to a second connector on the top of the housing, in which coupling of the second connector of the top to the first connector of the base is configured to bias the exposed conductive portions of the hot wires and the return wires against the conductive element to provide the electrical coupling between the hot wires and the return wires and to secure the hot wires and return wires within the device.

5. The device of claim 1, in which at least one of the top and the base comprises a locking device configured to engage insulation on each of the hot wires and the return wires.

6. The device of claim 5, in which the locking device comprises one or more teeth.

7. The device of claim 5, in which the locking device comprises one or more high friction surfaces.

8. The device of claim 1, in which the non-conductive housing comprises a plastic material.

9. The device of claim 1, in which the non-conductive housing comprises a flame retardant.

10. The device of claim 1, in which the non-conductive housing comprises a smoke suppressant.

11. The device of claim 1, in which the top of the non-conductive housing is configured to irreversibly engage the base of the non-conductive housing such that the top cannot be separated from the base without destruction of the non-conductive housing.

12. The device of claim 1, in which the first conductive element is a flat copper element.

13. The device of claim 12, in which the second conductive element is a flat copper element.

14. The device of claim 1, in which the device is configured to receive a third non-metallic sheathed electrical cable and provide electrical coupling between a hot wire of the third non-metallic sheathed electrical cable and the hot wire of the first non-metallic sheathed electrical cable and to provide electrical coupling between a return wire of the third non-metallic sheathed electrical cable and the return wire of the first non-metallic sheathed electrical cable.

15. The device of claim 14, in which the non-conductive housing is T-shaped.

16. The device of claim 1, in which the non-conductive housing is square shaped.

17. The device of claim 4, in which first connector of the base comprises threads.

18. The device of claim 17, in which the second connector of the top comprises a screw configured to mate to the threads of the first connector.

* * * * *